US010161125B2

(12) United States Patent
Herrezuelo De La Sierra et al.

(10) Patent No.: US 10,161,125 B2
(45) Date of Patent: Dec. 25, 2018

(54) SPATIAL STRUCTURE

(71) Applicants: Eduardo Herrezuelo De La Sierra, Madrid (ES); Juan Pablo Molina Valderrama, Madrid (ES)

(72) Inventors: Eduardo Herrezuelo De La Sierra, Madrid (ES); Juan Pablo Molina Valderrama, Madrid (ES)

( * ) Notice: Subject to any disclaimer, the term of this patent is extended or adjusted under 35 U.S.C. 154(b) by 0 days.

(21) Appl. No.: 15/551,694

(22) PCT Filed: Feb. 17, 2016

(86) PCT No.: PCT/ES2016/070102

§ 371 (c)(1),
(2) Date: Aug. 17, 2017

(87) PCT Pub. No.: WO2016/132009

PCT Pub. Date: Aug. 25, 2016

(65) Prior Publication Data

US 2018/0023284 A1 Jan. 25, 2018

(30) Foreign Application Priority Data

Feb. 18, 2015 (ES) ..... 201530198

(51) Int. Cl.
*E04B 1/19* (2006.01)

(52) U.S. Cl.
CPC ..... *E04B 1/1906* (2013.01); *E04B 2001/196* (2013.01); *E04B 2001/1927* (2013.01); *E04B 2001/1966* (2013.01)

(58) Field of Classification Search
CPC ..... E04B 1/1906; E04B 2001/1927; E04B 2001/196; F16B 21/18
See application file for complete search history.

(56) References Cited

U.S. PATENT DOCUMENTS 4,905,443 A 3/1990 Sutcliffe et al.
4,915,533 A * 4/1990 de la Haye ..... E04B 1/1906 403/171
5,054,950 A * 10/1991 Zillgen ..... A47B 47/0016 403/167
5,074,094 A 12/1991 Gassier
(Continued)

FOREIGN PATENT DOCUMENTS

ES 2362845 A1 7/2011

*Primary Examiner* — Paola Agudelo
(74) *Attorney, Agent, or Firm* — McNees Wallace & Nurick LLC

(57) ABSTRACT

A spatial structure that enables the assembly and disassembly of architectural elements quickly and easily, ensuring the necessary structural robustness and which basically comprises a node (1) with a plurality of sockets (2), a bar (3) intended for insertion at either of the two ends thereof in said sockets (2), a perforated screw (5) whose inner surface (6) allows the insertion of the end of the bar (3) and whose outer surface is coupled to the sockets (2), and a portion of flexible washer (8) suitable for insertion into the socket (2) of the node (1) and closing by compression as a result of the thrust exerted by the perforated screw (5) to adopt the shape of a substantially closed washer such that said bar (3) is locked inside the perforated screw (5), preventing the disassembly of the structure but not the rotation of the bar (3) inside the socket (2).

9 Claims, 7 Drawing Sheets

(56) References Cited

U.S. PATENT DOCUMENTS

| | | | | |
|---|---|---|---|---|
| 5,498,093 | A * | 3/1996 | Imai | E04B 1/1906 403/169 |
| 5,632,129 | A * | 5/1997 | Imai | E04B 1/1903 403/169 |
| 5,956,917 | A * | 9/1999 | Reynolds | E04B 1/3211 403/174 |
| 6,378,265 | B1 | 4/2002 | Konstandt | |
| 6,887,009 | B1 * | 5/2005 | Lopez | E04B 1/19 403/171 |
| 7,954,297 | B1 * | 6/2011 | Stearns | E04B 1/1903 52/578 |
| 2003/0159368 | A1 * | 8/2003 | Osterberg | E04B 1/1906 52/81.3 |
| 2003/0165353 | A1 * | 9/2003 | Clausell | E04B 1/19 403/56 |
| 2010/0129144 | A1 * | 5/2010 | Osborne | A47J 43/288 403/291 |
| 2015/0167713 | A1 * | 6/2015 | Schaerer | F16B 7/185 403/171 |

* cited by examiner

SPATIAL STRUCTURE

OBJECT OF THE INVENTION

The present invention generally relates to the field of construction and, in particular, to configurable modular spatial structure systems, of the type comprised of nodes and bars connected to each other to form a three-dimensional structure.

More specifically, the invention relates to a spatial structure that enables the creation of light and resistant architectural elements quickly and easily, which also ensures their modifiable and removable nature, all of this ensuring the necessary structural robustness and without the need for qualified personnel to be involved.

BACKGROUND OF THE INVENTION

Spatial structure systems built by joining elements of nodes and bars have long been used in the state of the art. Each node element can be joined to various bars in different directions and each bar is joined to two nodes, one at each end, so that, by means of these two types of elements, three-dimensional structures with widely variable configurations can be built.

Examples of these systems can be found in, for example, U.S. Pat. No. 4,905,443, U.S. Pat. No. 5,074,094 or U.S. Pat. No. 6,378,265, in which different systems of this type are described, and which, relying on the aforementioned nodes and bars, enable substantially rigid structures to be built.

However, these documents all have the same problem, which consists in the possibility of correcting the structure once it is built without having to disassemble the whole structure, or at least a large portion thereof.

In order to solve this problem, configurable modular spatial structures have been developed, which not only enable easy assembly but also simple disassembly, where furthermore, because of the design of their components, torsion stress generated in the interconnecting bars between the nodes can be relieved. An example of these systems can be found in document ES 2362845 which belongs to this same applicant.

However, even though the spatial structure of said document perfectly fulfills the requirements for which it was designed, both the disassembly and the number of elements involved are potential areas for improvement.

Specifically, the disassembly comprises two main aspects. One is the improvement of joint resilience in order to further facilitate unit disassembly. This is mainly due to the fact that the portion of washer described in ES 2362845, due to its design, may not be sufficiently resilient at times, which prevents the washer from entirely regaining its initial state when the retaining screw is removed, that is to say, it loses resilience, thus encumbering said disassembly.

Furthermore, due to the forces applied on the assembly once it has been mounted, the washer is trapped inside the groove at the end of the bar, preventing the disassembly of said bar or causing it to be dragged out in the event of disassembly.

DESCRIPTION OF THE INVENTION

The present invention relates to a modular spatial structure that solves the previously mentioned problems of the state of the art, since it allows easy assembly and disassembly with a reduced number of elements, all while fully complying with all the necessary mechanical loads.

The reversible nature of the spatial structure of the invention therefore enables changes in the structure to be carried out once it has been built, correcting building errors and replacing defective parts after the building thereof without affecting adjacent elements.

Moreover, as will be seen below, the coupling of the elements can easily be carried out with the help of a small tightening tool, without requiring complicated specialized tools or skilled labour, because the operator must only fit the end of the bar into the desired socket of the appropriate node and tighten the perforated screw in order to fasten both parts.

To achieve this, the spatial structure of the invention comprises at least:

- one node with a plurality of sockets on the surface thereof, wherein each socket has coupling means,
- one bar which is to be inserted at either of the two ends thereof into the sockets of the nodes and wherein said ends each comprise at least one retaining element,
- one perforated screw whose inner surface allows the insertion of the end of the bar and whose outer surface has complementary coupling means to the coupling means of the sockets;
- a portion of flexible washer suitable for insertion into the socket of the node and being closed by means of compression as a result of the thrust of the perforated screw in order to adopt the shape of a substantially closed washer which cooperates with the retaining element of the end of the bar such that said bar is locked inside the perforated screw, thus preventing the disassembly of the assembly but not the rotation of the bar within the socket.

Wherein the portion of flexible washer comprises two elements:

- a thin strip that corresponds to the outer diameter thereof, which is responsible for providing the washer with the greatest possible resilience; and
- on the inner diameter of said strip, a plurality of teeth greater in thickness than the strip, which project inwards such that said teeth alternate with empty areas where only the strip is found, forming a ring gear.

Thus, because of the outer structure of the washer, consisting of a strip, the required resilience is obtained so that the washer may regain its shape when it is no longer being compressed by the perforated screw, enabling the assembly to be released. On the other hand, because of the toothed portion or the teeth, which are considerably thicker than the said strip, the resistance needed to hold the bar and support the stress to which it is subjected is achieved.

The previous problem of the state of the art consisted in that, because the washers are solid, without removing material, the resilience of said washers, made of steel, was insufficient to enable them to regain their shape and enable the structure to be disassembled.

Furthermore, to avoid the entrapment of said portion of washer due to the stress transmitted by the bar, the retaining element of said portion of washer, which said bars have at the end thereof, no longer consists of a groove in which the portion of washer is inserted, as set out in the state of the art, but rather it consists of a step on which said washer rests when subjected to compression. However, by having one of its sides free, since a channel is not formed, the entrapment is prevented thereby releasing the assembly even though the toothed portions of the washer, which support the stress, deform slightly due to the stress.

Furthermore, the nodes of the system according to the invention comprise a plurality of sockets on the surface thereof in order to facilitate the building of different shaped structures. Thus, a single node can be coupled to numerous bars, each of them in a different direction such that a wide range of possibilities is covered. In addition, said joint between bars and nodes is carried out quickly and conveniently.

More specifically, mounting the structure only requires the operator to place a portion of washer into the corresponding socket, then inserting the end of a bar into a perforated screw with a smooth inner surface and whose outer surface has the coupling means to the sockets of the nodes. Thus, the coupling of said perforated screw in the socket causes the compression of the portion of washer, which closes onto the end of the bar and locks it in a reversible manner.

Subsequently, when the structure has to be disassembled or modified at any point, separating the appropriate bars from the nodes is sufficient, which is achieved by disengaging the perforated screws from the nodes, thus freeing the portion of washer from compression, therefore regaining its position, releasing the retaining means at the ends of the bars and enabling the same to be extracted without affecting the other nodes and bars of the structure.

Moreover, since the inner surface of the perforated screw is smooth like the outer surface of the bar, it enables the rotation of said bar once it is joined to the node, in such that the torsion stress is relieved, the bar working only with axial stress.

DESCRIPTION OF THE DRAWINGS

To complete the present description, and for the purpose of aiding in a better understanding of the characteristics of the invention, the present specification is accompanied by a set of drawings as an integral part thereof, which by way of illustration and not limitation, represent the following.

PREFERRED EMBODIMENT OF THE INVENTION

Figure 1A:
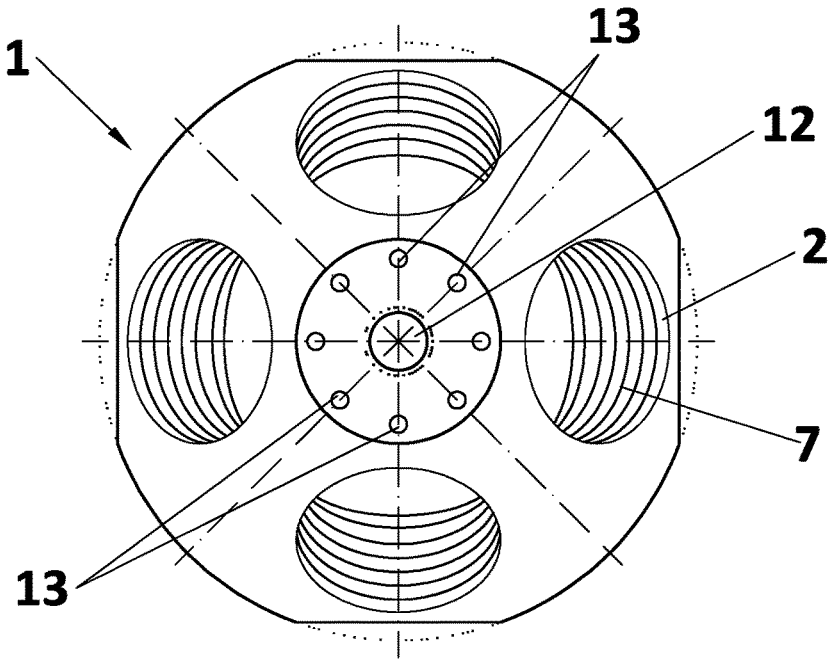
FIG. 1*a* shows a top plan view of the node of the spatial structure of the present invention.

According to the figures, in which a preferred embodiment of the invention is shown, the spatial structure of the present invention comprises:

A node (1) with a plurality of sockets (2) on the surface thereof, wherein each socket has coupling means (7), a bar (3) which is to be inserted at either of the two ends thereof into the sockets (2) of the nodes (1) and wherein said ends each comprise at least one retaining element (4), a perforated screw (5) whose inner surface (6) allows the insertion of the end of the bar (3) and whose outer surface has complementary coupling means (7') to the coupling means (7) of the sockets (2);

a portion of flexible washer (8) suitable for insertion into the socket (2) of the node (1) and being closed by means of compression as a result of the thrust of the perforated screw (5) in order to adopt the shape of a substantially closed washer which cooperates with the retaining element (4) of the end of the bar (3) such that said bar (3) is locked inside the perforated screw (5), thus preventing disassembly of the assembly but not the rotation of the bar (3) within the socket (2).

Wherein the portion of flexible washer (8) comprises two elements:

a thin strip (10) that corresponds to the outer diameter thereof, which is responsible for providing the washer with the greatest possible resilience; and on the inner diameter of said strip, a plurality of teeth (11) greater in thickness than the strip, which project inwards such that said teeth (11) alternate with empty areas where only the strip (10) is found, forming a portion of ring gear.

Figure 1B:
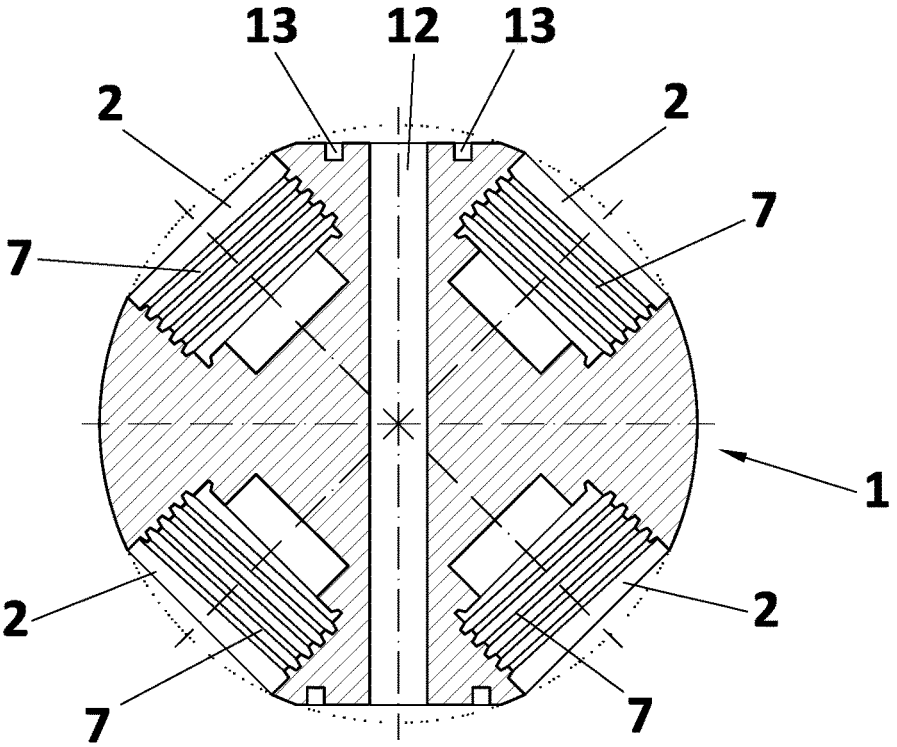
FIG. 1*b* shows an elevation view of the node of the previous figure with a cross-section through the central plane.
Figure 6A:
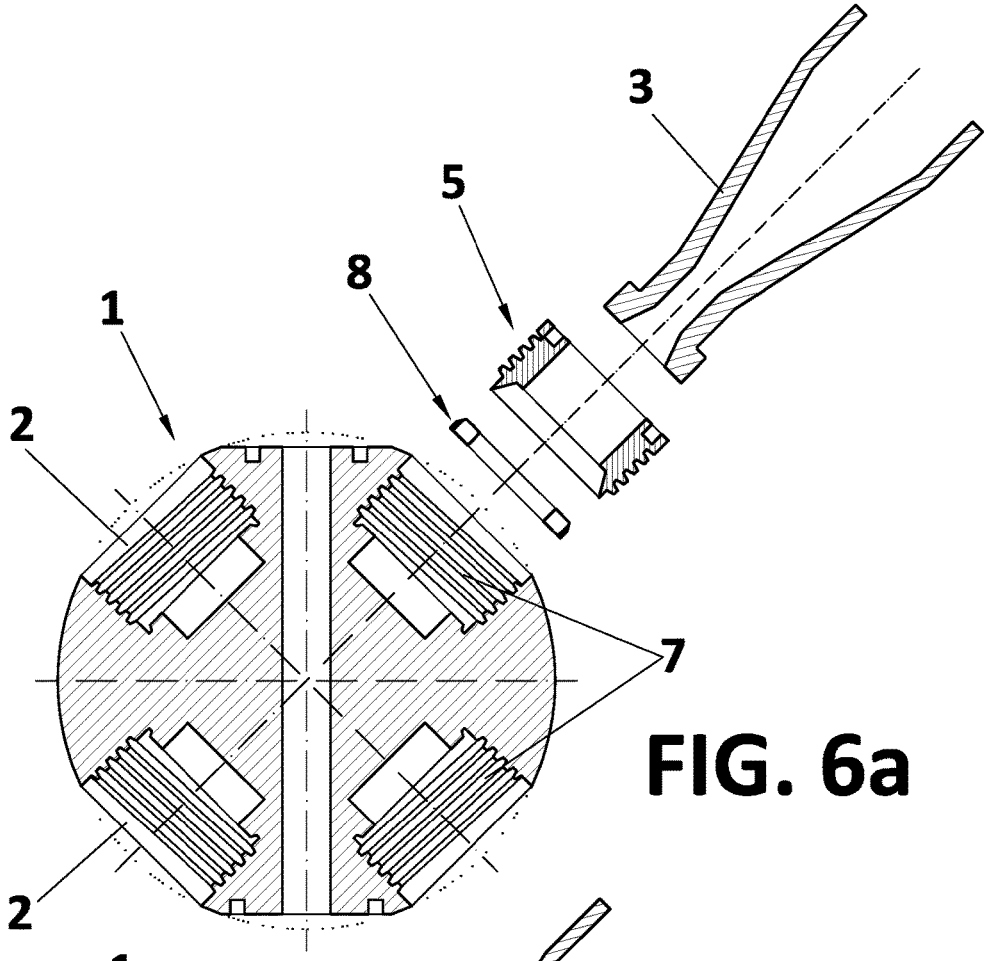
FIGS. 6*a* and 6*b* show the cross-sectional views of an exploded perspective of the assembly elements and of the structure of the invention with all its elements coupled and in operating position, respectively.
Figure 6B:
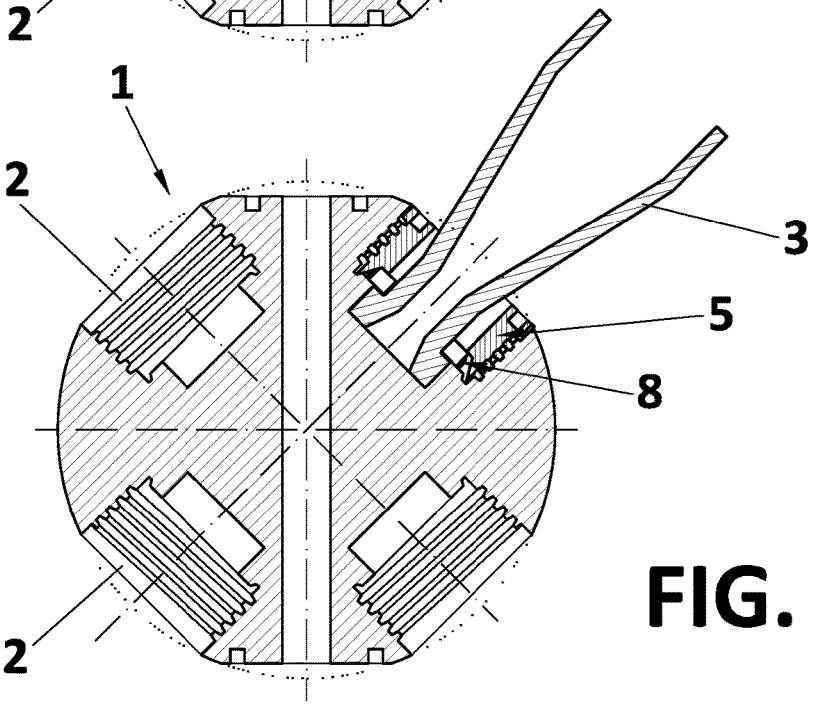

Furthermore, as may be seen in the figures, especially in FIGS. 1*b*, 6*a* and 6*b*, the node (1) further comprises a through hole (12) that defines its vertical orientation, that is to say, it places it within the space. Preferably, according to the preferred embodiment of the invention, a bushing is also included (not shown in the figures) inserted in the central area of said through hole (12).

The purpose of this bushing to be able to provide support and fixing for the outer pieces of the modular structure such as fixing the fastening and safety elements, or securing the entire structure to a support point (ground or vertical surface). Furthermore, when said through hole (12) does not serve as a support for any outer piece of the modular structure, the through hole (12) can be covered up with a plug, a countersunk screw or any other similar element.

Moreover, according to the preferred embodiment of the invention shown in said figures, the poles of the node (1) in which the through hole (12) is located have a flattened configuration, which further facilitates the positioning within the space of the node (1), by defining its vertical orientation, and therefore facilitates the mounting of the final structure.

Figure 2:
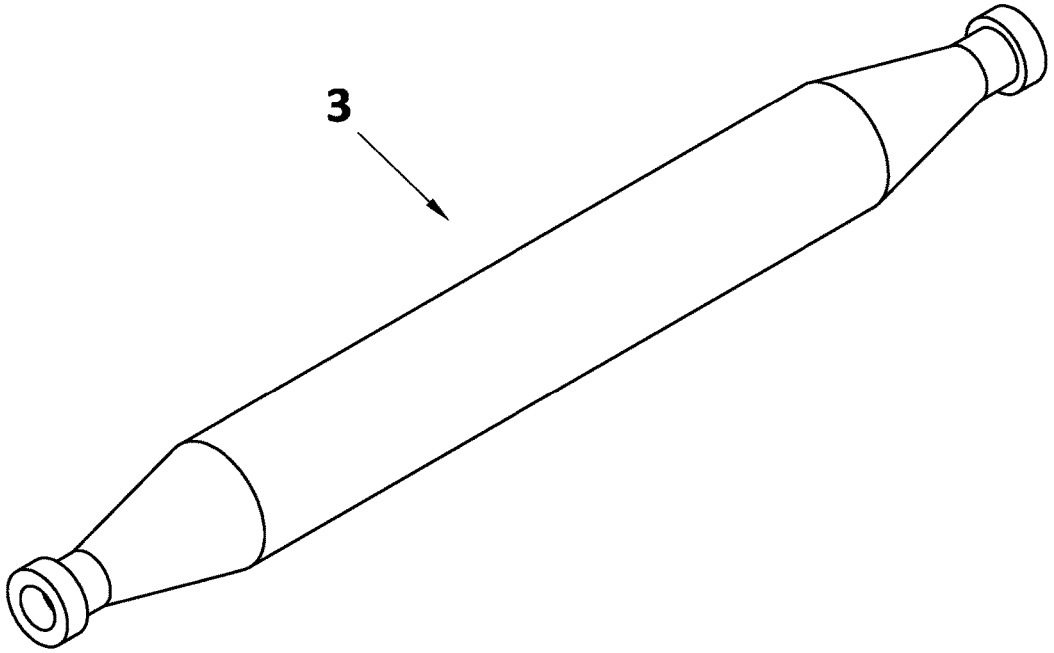
FIG. 2 shows a perspective view of one of the bars that constitute the spatial structure of the present invention.

Furthermore, as can be seen in FIG. 1, in the flat faces formed by said flattened configuration, the node (1) has a plurality of holes (13) with a small diameter, preferably 8, distributed at equal angles around the through hole (12) in such a way that the pieces that are secured or fastened to the node (1) may be oriented by turning at specific 45° angles Moreover, the bar (3), shown in FIG. 2, is responsible for transmitting the loads or stress from the node (1) in which they appear to the nodes (1) in which they are transmitted to structure supports, preferably having an elongated and cylindrical shape, with a larger transverse cross-section at the centre or, in other words, wherein the ends have a reduced transverse cross-section suitable for insertion into the sockets (2) of the nodes (1).

In addition, each end of the bar (3) has a retaining element (4) for retaining the portion of the flexible washer (8).

Figure 5A:
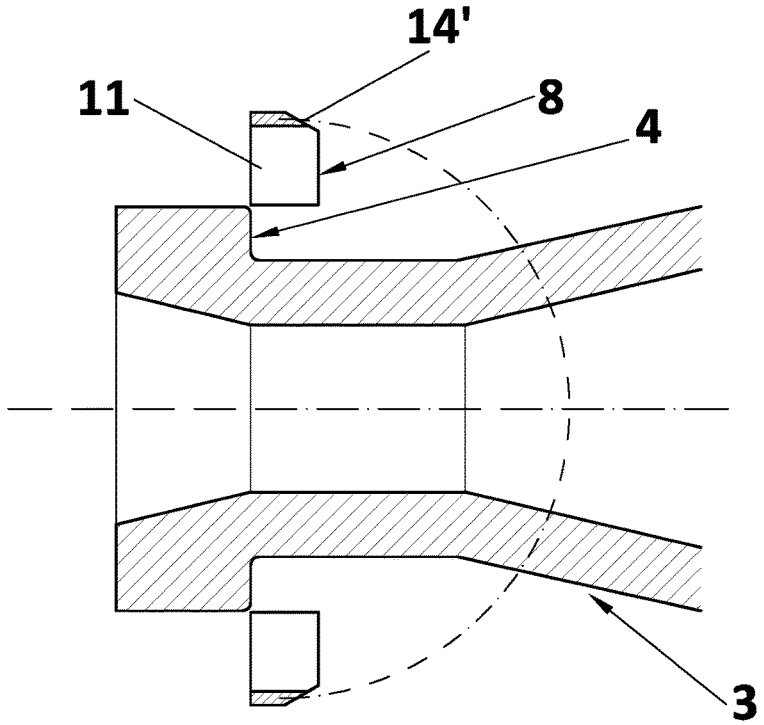
FIGS. 5*a* and 5*b* show the views of the positions in which the portion of flexible washer is positioned in relation to the bar when it is disengaged, uncompressed and in working position, and when it is compressed by means of the perforated screw, respectively.
Figure 5B:
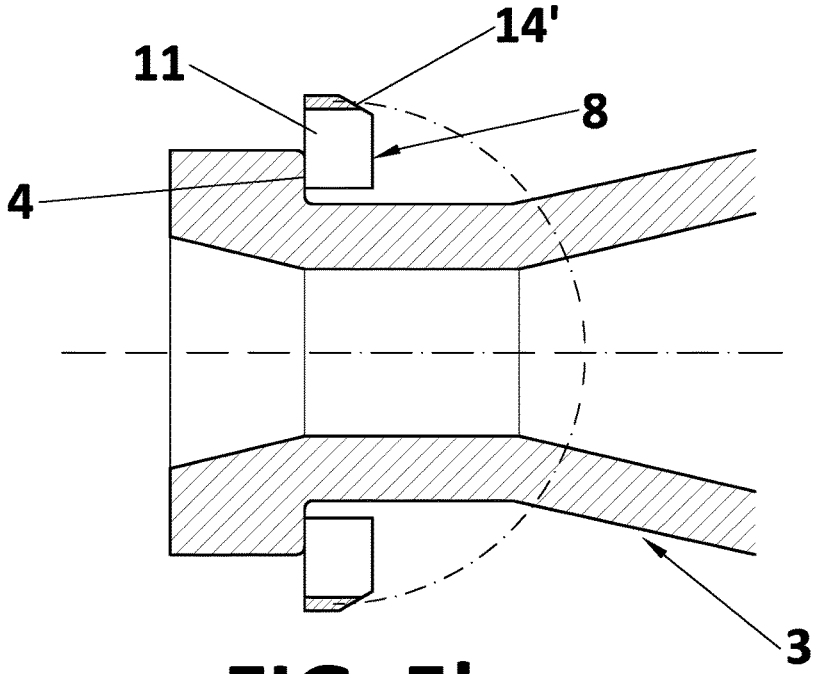

Specifically, according to a possible embodiment of the invention shown in FIGS. 5*a* and 5*b*, said retaining element (4) is formed by a perimeter step.

In this way, the bars (3) will have, in the first section that corresponds to the free end thereof, an outer diameter which will enable them to pass tightly yet freely through the inside the perforated screw (5), to then, in a second section further away from the free end, decrease said diameter in order to form the step that constitutes the retaining element (4) of the portion of the flexible washer (8). This second section having a constant diameter extends over a length greater than twice the width of the portion of flexible washer (8) to then increase again progressively forming a third conical section until it reaches the maximum outer diameter of the central area of the bar (1).

Figure 3A:
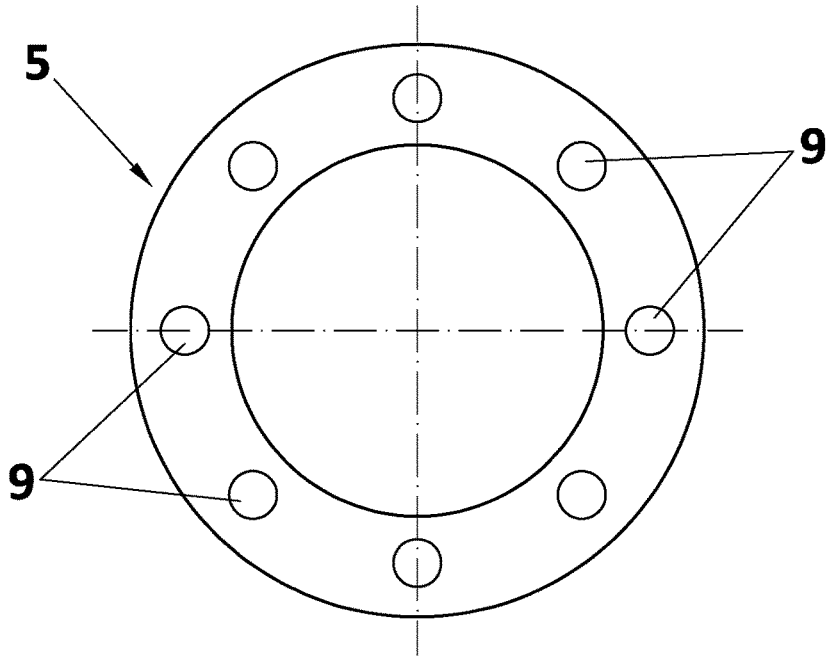
FIGS. 3*a* and 3*b* show an elevation view and a cross-sectioned side view of the perforated screw of the spatial structure of the present invention.
Figure 3B:
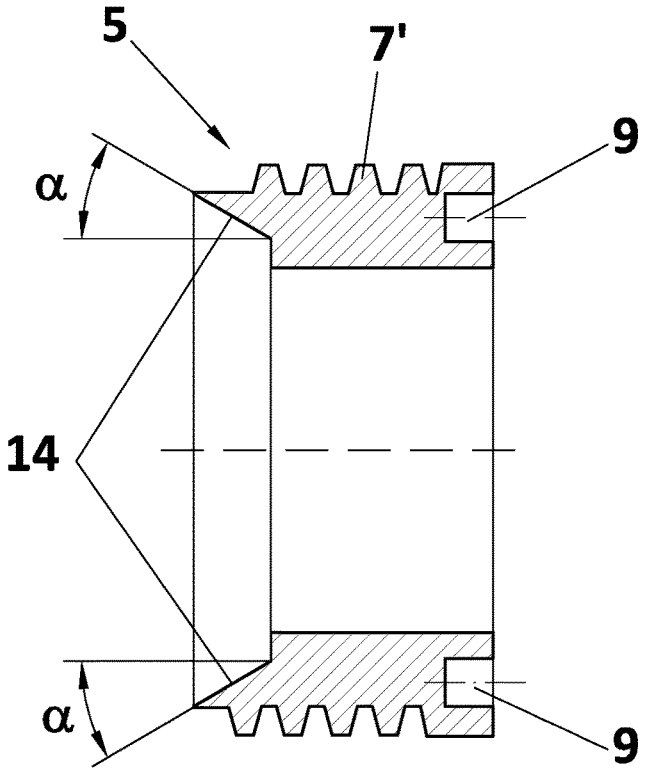

As regards the perforated screw (5), and according to a preferred embodiment shown in FIGS. 3*a* and 3*b*, the complementary coupling means (7") are formed by a male threaded portion on its outer surface, which will logically be complementary to a similar female thread, which will form the coupling means (7) of the sockets (2).

FIGS. 3*a* and 3*b* also show that the inner surface (6) of the perforated screw (5) is smooth, as well as the outer surface of the bar (3), such that the bar (3) is free to rotate once inserted inside the perforated screw (5). Furthermore, this inner surface of the perforated screw (5), because of its length and diameter that are compatible with the diameter of the end of the bar (3), allows said bar (3) to be guided in such a way that it only enters into the socket (2) of the node (1) in the correct position, thus facilitating the mounting for the operator.

In its lower part, as can be seen in FIG. 3*b*, the perforated screw (5) has an inclined plane (14) with a suitable angle α, which couples to an inclined plane (14') with the same angle α of the portion of flexible washer (8) as described below. By coupling these two planes, upon rotation of the perforated screw (5) in order to carry out its torque function and to progress along the longitudinal axis thereof towards the inside of the socket (2) of the node (1), the portion of flexible washer (8) is compressed inward, substantially forming a closed washer, being coupled to the retaining device (4) of the end of the bar (3) and thereby being secured.

Furthermore, FIG. 3*b* also shows that said inclined plane (14) of the perforated screw (5) ends in small step perpendicular to the inner surface in longitudinal direction of the perforated screw (5). Said step, relatively small in size in relation to the other surfaces of the perforated screw (5), has the function of acting as a stop and fastener for the portion of flexible washer (8). In this way, the rotation of the portion of flexible washer (8) is prevented when the perforated screw (5) exerts torque force, thus securing the portion of flexible washer (8) so that its only motion is that of compression and reduction of its diameter in order to move from an initial open state to a final closed state.

The perforated screw (5) also has a series of grooves (9) suitable for coupling therein a tightening part or tool so that the operator can both secure the assembly and disassemble it. Furthermore, said grooves (9), are preferably circular and distributed at equal 45° angles such that they are complementary to the holes (13) in the flattened areas of the node (1), thus multiplying the number of support points and orientations in which outer parts can be arranged, thus making its orientation in space unimportant.

As regards the angle α of inclination of both the inclined planes (14) of the perforated screw (5) and the inclined sections (14') of the portion of flexible washer (8), according to the preferred embodiment, these are preferably comprised between 30° and 45°, since the makeup of said portion of flexible washer (8) shows remarkable flexibility, higher angles of attack will not be required such as in the prior state of the art wherein said angle was 45°.

This, as well as having the clear advantage that less effort will be have to be exerted when mounting the assembly, becomes one of the main advantages of the invention, which is made possible due to the design of the portion of flexible washer (8) which is proposed herein.

Specifically, the significant improvements made in the flexibility of the portion of flexible washer (8) as a result of its new design, allow the angle α of inclination of the inclined sections (14') of the portion of flexible washer (8) to be decreased to, as previously stated, to between 30° and 45°. This has two major advantages:

Maximizing the surface of the teeth (11) responsible for supporting the stress, thus allowing the assembly to bear greater mechanical loads, or Enabling an alternative embodiment (not shown in the figures) of the portion of flexible washer (8) with a double inclined section (14'), one on each side, such that it does not matter how the operator positions it inside the socket (2) of the node (1). This is possible because, having said inclined sections (14') with a maximum angle α of inclination of 45°, there is enough space within the thickness of the portion of the washer (8) for two such sections, without having to oversize the same.

Figure 7A:
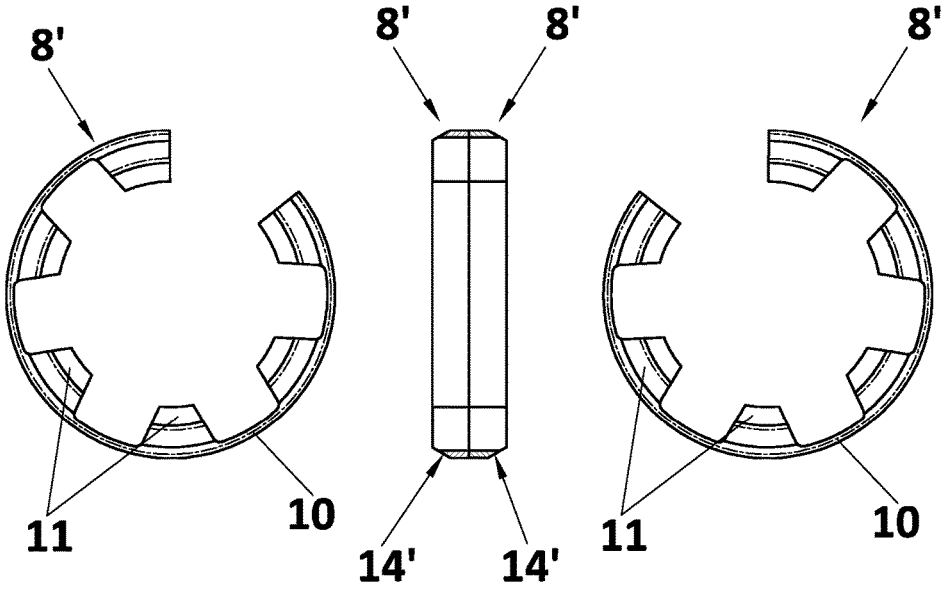
FIGS. 7*a* and 7*b* show views of an alternative embodiment of the portion of flexible washer seen from the outer and the inner faces, respectively.
Figure 7B:
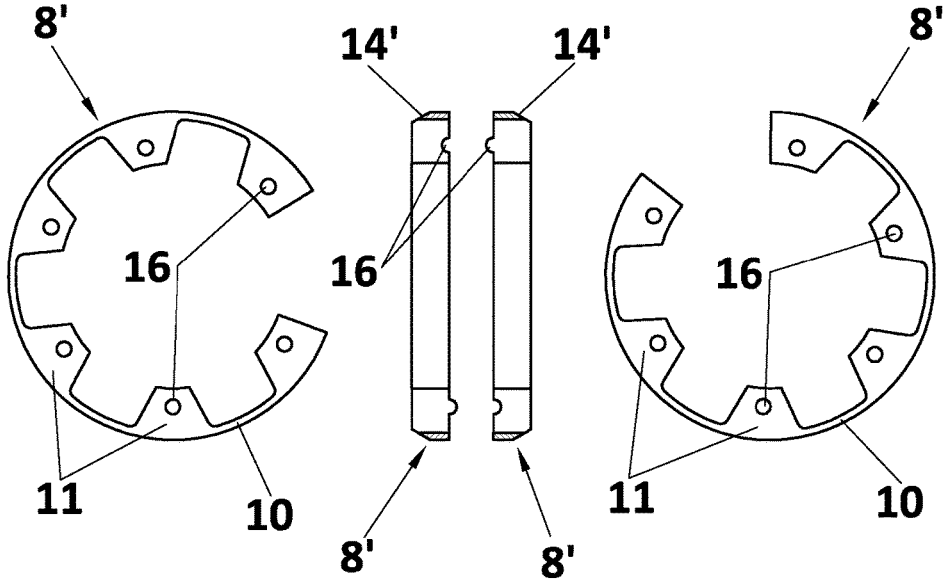

According to another possible alternative embodiment as shown in FIGS. 7*a* and 7*b*, the spatial structure of the invention has two portions of flexible washer (8') joined together by their inner faces due to a tongue and groove type joint system (16) or similar that said portions of flexible washer (8') have, such that they are symmetrical on both faces, that is to say, having inclined planes (14') on both sides, preventing the operator from inserting the portion of washer in the wrong position, thus further minimizing assembly time.

Although it can be easily deduced that the set of the two portions of flexible washer (8,8') double the thickness of a single portion, this embodiment also has the advantage of providing increased joint strength, which will allow stronger bars (3) or bars (3) with an increased cross-section to be incorporated.

However, as previously noted, since the second section of the end of the bars (3) has a constant diameter longer than twice the width of said portion of flexible washer (8), said section will therefore be sufficient to ensure the coupling and release of the bar (3) and the node (1).

Figure 4:
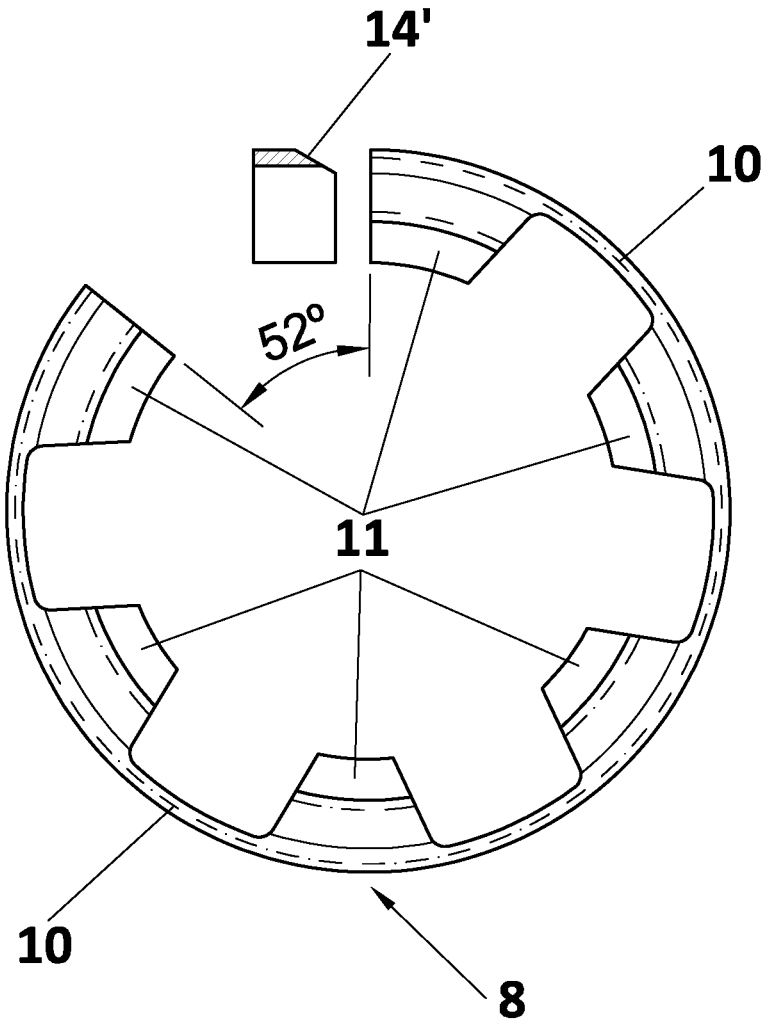
FIG. 4 shows a view of the portion of flexible washer of the spatial structure of the present invention.

Finally, it should be noted that, as can be seen in FIG. 4, the portion of flexible washer (8,8') is defined such that in resting position, that is to say, without undergoing compression, it covers a circular arc of 313°, which is to say, that its two free ends form an angle of 52° with respect to the geometric centre through which its inner and outer diameters pass.

The invention claimed is:

1. A spatial structure comprising at least:

one node (1) with a plurality of sockets (2), wherein each socket has coupling means (7), one bar (3) comprising two ends and configured to be inserted at either of the two ends into the sockets (2) of the nodes (1) and wherein said two ends each comprise at least one retaining element (4), one perforated screw (5) having an inner surface (6) that allows the insertion of one of the ends of the bar (3), the perforated screw further comprising an outer surface having coupling means (7') formed by a male threaded portion complementary to a similar female thread that forms the coupling means (7) of the sockets (2), and a portion of flexible washer (8, 8') being shaped as an open circle and suitable for insertion into the socket (2) of the node (1) and being closed by means of compression as a result of the thrust of the perforated screw (5) in order to adopt the shape of a substantially closed washer which cooperates with the at least one retaining element (4) of one of the two ends of the bar (3), such that said bar (3) is locked inside the perforated screw (5), thus preventing disassembly of the assembly but not rotation of the bar (3) within the socket (2);

where the perforated screw (5) has an inclined plane (14) with an angle $\alpha$, and the portion of flexible washer (8) has a second inclined plane (14') with an angle $\alpha$ that corresponds with the inclined plane (14) of the perforated screw such that when the perforated screw is coupled with the portion of flexible washer the portion of flexible washer is compressed inward substantially forming a closed circle;

characterized in that the portion of flexible washer (8) comprises:

a strip (10) having a thickness, an inner diameter and an outer diameter thereof, and said strip (10) further comprising a plurality of teeth (11) greater in thickness than the thickness of the strip (10) and projecting inwards, wherein said plurality of teeth (11) alternate with empty areas where only the strip (10) is found, forming a portion of ring gear;

and in that the retaining element (4) of the bar (3) for retaining the portion of flexible washer (8) is formed by a perimeter step.

2. The spatial structure according to claim 1, characterized in that the bars (3) comprise:

a first section, which corresponds to a free end thereof, and having an outer diameter such that it enables the free end to pass through the inside of the perforated screw (5);

a second section, further away from the free end, which is smaller in diameter than the first section, forming the perimeter step that constitutes the retaining element (4) of the portion of flexible washer (8), and a third conical section reaching up to the maximum outer diameter of the central area of the bar (1), wherein said second section, having a constant diameter, extends over a greater length than twice the width of the portion of flexible washer (8).

3. The spatial structure according to claim 1, characterized in that the inclined plane (14) of the perforated screw (5) and the inclined plane (14') of the portion of flexible washer (8) are comprised between 30° and 45°.

4. The spatial structure according to any of claim 1, characterized in that the portion of flexible washer (8) has a two inclined planes (14'), one on each side, such that it does not matter how it is positioned within the socket (2) of the node.

5. The spatial structure according to any of claim 1, characterized in that it comprises two portions of flexible washer (8') joined together by their inner faces by a joint system (16) such that both sides have the same inclined planes (14').

6. The spatial structure according to claim 1, characterized in that the portion of flexible washer (8, 8') a circular arc with a circumference of 313°.

7. The spatial structure according to claim 1, characterized in that the node (1) has a through hole (12) that defines the vertical orientation and in that poles in which the through hole (12) is located have a flattened configuration forming flat faces having a plurality of holes (13) distributed at equal angles around the through hole (12).

8. The spatial structure according to claim 7, characterized in that the perforated screw (5) has grooves (9) distributed at equal angles which are suitable for coupling therein a part or tool for the assembly and/or disassembly.

9. The spatial structure according to claim 8, characterized in that the plurality of holes (13) and the grooves (9) are distributed at equal angles every 45°, such that they are complementary to each other.

* * * * *